US010486121B2

(12) United States Patent
Polk, III

(10) Patent No.: US 10,486,121 B2
(45) Date of Patent: Nov. 26, 2019

(54) MIXING ASSEMBLY FOR MIXING A PRODUCT

(71) Applicant: Shorefield Holdings, LLC, Waynesfield, OH (US)

(72) Inventor: Louis Frederick Polk, III, Eden Prarie, MN (US)

(73) Assignee: Shorefield Holdings, LLC, Waynesfield, OH (US)

( * ) Notice: Subject to any disclaimer, the term of this patent is extended or adjusted under 35 U.S.C. 154(b) by 5 days.

(21) Appl. No.: 15/061,952

(22) Filed: Mar. 4, 2016

(65) Prior Publication Data

US 2017/0252713 A1 Sep. 7, 2017

(51) Int. Cl.

| | |
|---|---|
| ***B01F 13/00*** | (2006.01) |
| ***B01F 3/12*** | (2006.01) |
| ***B01F 15/00*** | (2006.01) |

(52) U.S. Cl.

CPC ..... *B01F 13/005* (2013.01); *B01F 3/1221* (2013.01); *B01F 13/002* (2013.01); *B01F 15/00512* (2013.01); *B01F 2215/0022* (2013.01)

(58) Field of Classification Search

CPC ..... A47J 43/27; B01F 13/005; B01F 13/0022; B01F 13/002; B01F 7/00391; B01F 7/00408; B01F 7/00433; B01F 5/0615; A21C 1/02; B29B 7/424

USPC ..... 366/130

See application file for complete search history.

(56) References Cited

U.S. PATENT DOCUMENTS

| | | | | |
|---|---|---|---|---|
| 1,641,155 | A | 9/1927 | Clausing | |
| 3,164,375 | A * | 1/1965 | Frenkel | A21C 1/065 241/159 |
| 3,758,222 | A | 9/1973 | Oakes | |
| D247,279 | S | 2/1978 | Marceca | |
| D294,218 | S | 2/1988 | Johnson | |
| 4,832,968 | A | 5/1989 | Forage et al. | |
| 4,892,429 | A | 1/1990 | Giannuzzi | |
| 5,000,658 | A | 3/1991 | Niskanen | |
| 5,085,431 | A | 2/1992 | McGuire | |

(Continued)

FOREIGN PATENT DOCUMENTS

| | | |
|---|---|---|
| FR | 712629 | 10/1931 |

OTHER PUBLICATIONS

Ex Parte Quayle Action cited in U.S. Appl. No. 29/557,096 dated Apr. 25, 2017, 4 pgs.

(Continued)

*Primary Examiner* — Tony G Soohoo
*Assistant Examiner* — Elizabeth Insler
(74) *Attorney, Agent, or Firm* — Cooper Legal Group, LLC

(57) ABSTRACT

A mixing assembly includes a container having a wall that defines an interior chamber within which a product to be mixed is received. A mixing structure is received within the interior chamber and mixes the product. The mixing structure has a body portion that extends along a body axis between a first end of the body portion and a second end of the body portion. The first end of the body portion has a first cross-sectional size. The second end of the body has a second cross-sectional size that is larger than the first cross-sectional size. The body portion has a wall that extends helically about the body axis between the first end and the second end. The wall defines a channel that extends (Continued)

helically about the body axis between the first end and the second end.

20 Claims, 4 Drawing Sheets

(56) References Cited

U.S. PATENT DOCUMENTS 5,160,225 A 11/1992 Chern
5,182,087 A * 1/1993 Lilja ..... B01F 7/247 210/208
5,316,193 A 5/1994 Heiberger
5,441,118 A 8/1995 Cruz, Jr.
5,494,198 A 2/1996 Heiberger
D368,943 S 4/1996 Johnson
5,901,882 A 5/1999 Seigel
5,944,486 A 8/1999 Hodgkins, Jr.
D421,557 S 3/2000 Wang
D422,173 S 4/2000 He
6,164,469 A 12/2000 Sartore
6,379,032 B1 4/2002 Sorensen
6,419,436 B1 7/2002 Gaudron
D462,895 S 9/2002 Gaudron
D466,371 S 12/2002 Parker
6,679,661 B2 1/2004 Huang
6,755,835 B2 6/2004 Schultheiss et al.
D528,862 S 9/2006 Li
D566,468 S 4/2008 Sandy
D593,141 S 5/2009 Gaudron
D605,933 S 12/2009 Gaudron
D609,969 S 2/2010 McKinney
7,722,299 B2 5/2010 Lenander
7,753,234 B1 7/2010 Heiberger
D626,409 S 11/2010 Hooley
D628,483 S 12/2010 McKinney
D633,379 S 3/2011 Chambers et al.
D637,871 S 5/2011 Frank
7,934,895 B2 5/2011 Ernst
D641,587 S 7/2011 Colburn
D642,900 S 8/2011 McDuff et al.
8,029,215 B2 10/2011 Gentry
D657,251 S 4/2012 Rinderer
8,192,123 B2 6/2012 Ernst
D664,392 S * 7/2012 Enghard ..... D7/376
8,210,375 B2 7/2012 Heiberger
8,584,877 B2 11/2013 Heiberger
D696,551 S 12/2013 Meyers
8,646,663 B2 2/2014 Heiberger
D701,254 S 3/2014 Carlson
8,858,145 B2 10/2014 Su et al.
D717,601 S 11/2014 Dixon
D737,443 S 8/2015 Ciravolo et al.
D739,174 S 9/2015 Elsaden
D741,637 S 10/2015 Palermo
D747,624 S 1/2016 Walker
9,248,423 B2 2/2016 Cerasani
D764,232 S 8/2016 Marina et al.
D771,990 S 11/2016 Horowitz
D775,893 S 1/2017 Buckley et al.
D777,518 S 1/2017 Frazier
D779,872 S 2/2017 Bergstrom
D780,516 S 3/2017 Cornelius
D781,104 S 3/2017 Cerasani
9,587,662 B2 3/2017 Glass
9,593,705 B2 3/2017 Call et al.
D788,197 S 5/2017 Ford
9,687,915 B2 6/2017 Durfee
9,731,358 B2 8/2017 Allen et al.
2002/0130600 A1 9/2002 Bigio
2004/0047231 A1 3/2004 Coll
2004/0146377 A1 7/2004 Chen
2005/0008450 A1 1/2005 Gauthier
2005/0031434 A1 2/2005 Gaudron
2005/0079027 A1 4/2005 Ernst
2005/0084360 A1 4/2005 Panasik et al.
2006/0018730 A1 1/2006 Ernst
2006/0051491 A1 3/2006 Levitt
2010/0224631 A1 11/2010 Roth
2010/0290849 A1 11/2010 Mirchandami
2012/0195704 A1 8/2012 White
2014/0231378 A1* 8/2014 Roos ..... A61J 9/00 215/387
2014/0363244 A1 12/2014 Allen
2014/0363249 A1 12/2014 Oka
2016/0223005 A1 8/2016 Hettich
2016/0223006 A1 8/2016 Hettich
2017/0065943 A1* 3/2017 Dayton ..... B01F 13/0022

OTHER PUBLICATIONS

Reply Ex Parte Quayle Action cited in U.S. Appl. No. 29/557,096 dated Jun. 26, 2017, 4 pgs.
Notice of Allowance cited in U.S. Appl. No. 29/557,096 dated Sep. 13, 2017, 5 pgs.
Ex Parte Quayle Action cited in U.S. Appl. No. 29/557,098 dated Apr. 28, 2017, 5 pgs.
Reply Ex Parte Quayle Action cited in U.S. Appl. No. 29/557,098 dated Jun. 26, 2017, 5 pgs.
Notice of Allowance cited in U.S. Appl. No. 29/557,098 dated Aug. 8, 2017, 5 pgs.

* cited by examiner

MIXING ASSEMBLY FOR MIXING A PRODUCT

TECHNICAL FIELD

The instant application is directed towards a mixing assembly. For example, the instant application is directed towards a mixing assembly for mixing a product.

BACKGROUND

Mixing assemblies may be used to mix a product. A mixing assembly may be used, for example, to mix a heterogeneous product into a homogeneous product.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a mixing assembly comprises a container having a wall that defines an interior chamber within which a product to be mixed is received. The mixing assembly comprises a mixing structure configured to be received within the interior chamber and mix the product. The mixing structure has a body portion that extends along a body axis between a first end of the body portion and a second end of the body portion. The first end of the body portion has a first cross-sectional size. The second end of the body has a second cross-sectional size that is larger than the first cross-sectional size. The body portion has a wall that extends helically about the body axis between the first end and the second end. The wall defines a channel that extends helically about the body axis between the first end and the second end. The wall has a wall length, along a wall axis that is substantially parallel to the body axis, between a first edge of the wall and a second edge of the wall. The channel has a channel length, along a channel axis that is substantially parallel to the body axis, between the first edge of the wall and a third edge of the wall, the wall length larger than the channel length.

In an example, a mixing assembly comprises a container having a wall that defines an interior chamber within which a product to be mixed is received. A mixing structure is configured to be received within the interior chamber and mix the product. The mixing structure is movable within the container with respect to the wall. The mixing structure has a body portion that extends along a body axis between a first end of the body portion and a second end of the body portion. The first end of the body portion has a first cross-sectional size. The second end of the body has a second cross-sectional size that is larger than the first cross-sectional size. The body portion has a wall that extends helically about the body axis between the first end and the second end. The wall defines a channel that extends helically about the body axis between the first end and the second end. The product flows through the channel to mix the product as the mixing structure moves within the container.

In an example, a mixing assembly comprises a container having a wall that defines an interior chamber within which a product to be mixed is received. A mixing structure is configured to be received within the interior chamber and mix the product. The mixing structure has a body portion that extends along a body axis between a first end of the body portion and a second end of the body portion. The first end of the body portion has a first cross-sectional size. The second end of the body has a second cross-sectional size that is larger than the first cross-sectional size. The body portion has a wall that extends helically about the body axis between the first end and the second end. The wall defines a channel that extends helically about the body axis between the first end and the second end. A transverse axis that perpendicularly intersects the body axis does not intersect the channel at opposing sides of the wall.

The following description and annexed drawings set forth certain illustrative aspects and implementations. These are indicative of but a few of the various ways in which one or more aspects may be employed. Other aspects, advantages, and/or novel features of the disclosure will become apparent from the following detailed description when considered in conjunction with the annexed drawings.

DETAILED DESCRIPTION

Figure 1:
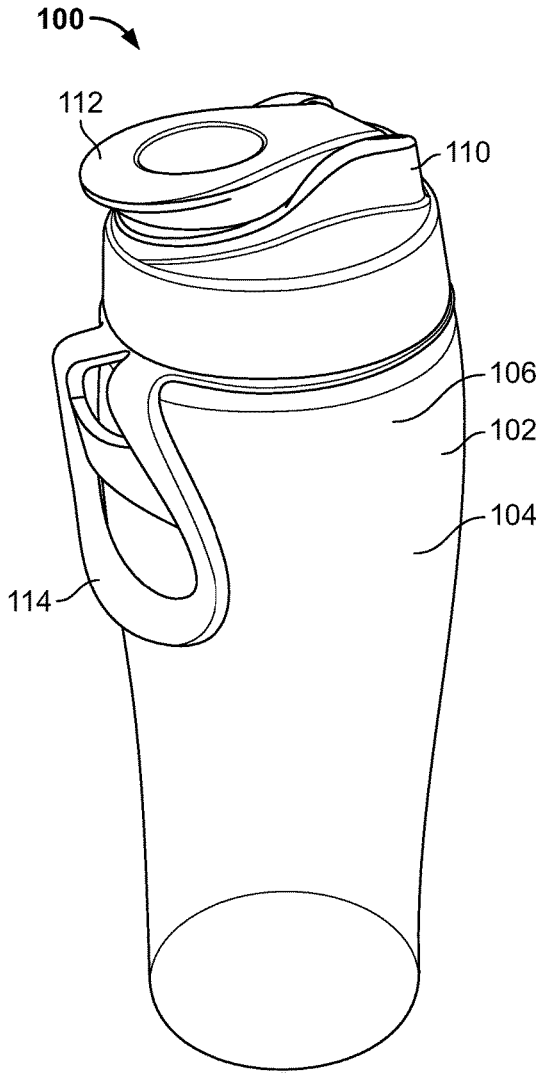
FIG. 1 is an illustration of an example mixing assembly.
Figure 2:
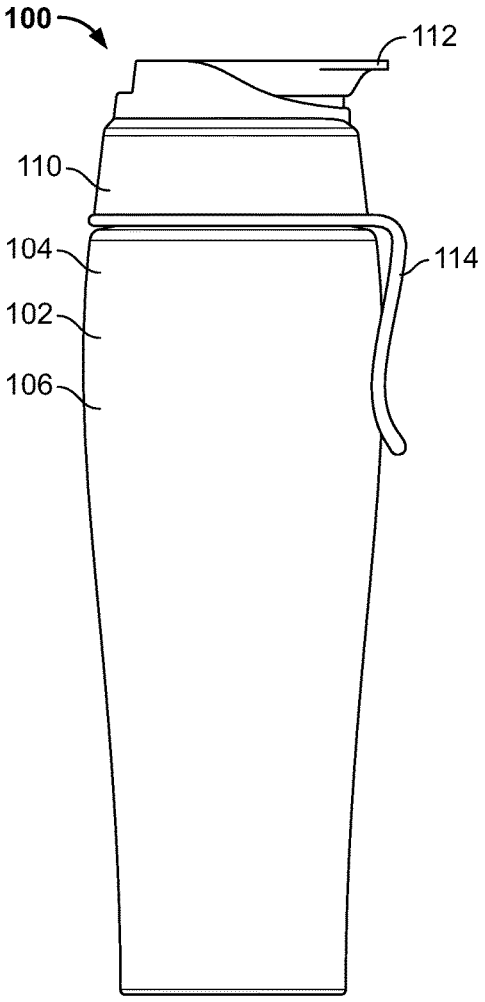
FIG. 2 is an illustration of a portion of an example mixing assembly.

The claimed subject matter is now described with reference to the drawings, wherein like reference numerals are used to refer to like elements throughout. In the following description, for purposes of explanation, numerous specific details are set forth in order to provide an understanding of the claimed subject matter. It is evident, however, that the claimed subject matter may be practiced without these specific details. In other instances, structures and devices are illustrated in block diagram form in order to facilitate describing the claimed subject matter. Relative size, orientation, etc. of parts, components, etc. may differ from that which is illustrated while not falling outside of the scope of the claimed subject matter.

Referring to FIG. 1, an example mixing assembly 100 is illustrated. The mixing assembly 100 can be used to assist in mixing a heterogeneous product into a substantially homogeneous product. For example, the mixing assembly 100 may contain a substantially heterogeneous, unmixed product comprising a liquid (e.g., water, milk, juice, etc.) and a non-liquid (e.g., a powder, a protein powder, a dietary supplement, etc.). The mixing assembly 100 can assist in mixing the liquid and the non-liquid so as to form a substantially homogeneous mixture.

The mixing assembly 100 may comprise a container 102. The container 102 has a wall 104 that defines an interior chamber 106 within which a product (e.g., a liquid (e.g., water, milk, juice, etc.) and a non-liquid (e.g., a powder, a protein powder, a dietary supplement, etc.)) to be mixed is received. In an example, the mixing assembly 100 can be shaken by a user to assist in the mixing. The container 102 comprises any number of resilient, non-flexible materials, that are resistant to corrosion, breakage, fracturing, leakage, etc. For example, the container 102 may comprise plastics, composite materials, or the like.

The mixing assembly 100 may comprise a cover 110. The cover 110 can selectively shield an opening defined by the wall 104 of the container 102. In an example, the cover 110 may comprise a removable cap that can be selectively attached to the container 102 or removed from the container 102. In the illustrated example, the cover 110 has a cap 112. The cap 112 can selectively cover an opening defined within the cover 110. The cap 112 can be attached in any number of ways to the cover 110, such as by a hinge, or the like. In some examples, a holder 114 can be provided in attachment to the container 102. The holder 114 comprises a loop defining an opening that facilitates holding of the mixing assembly 100 by the user.

Figure 3:
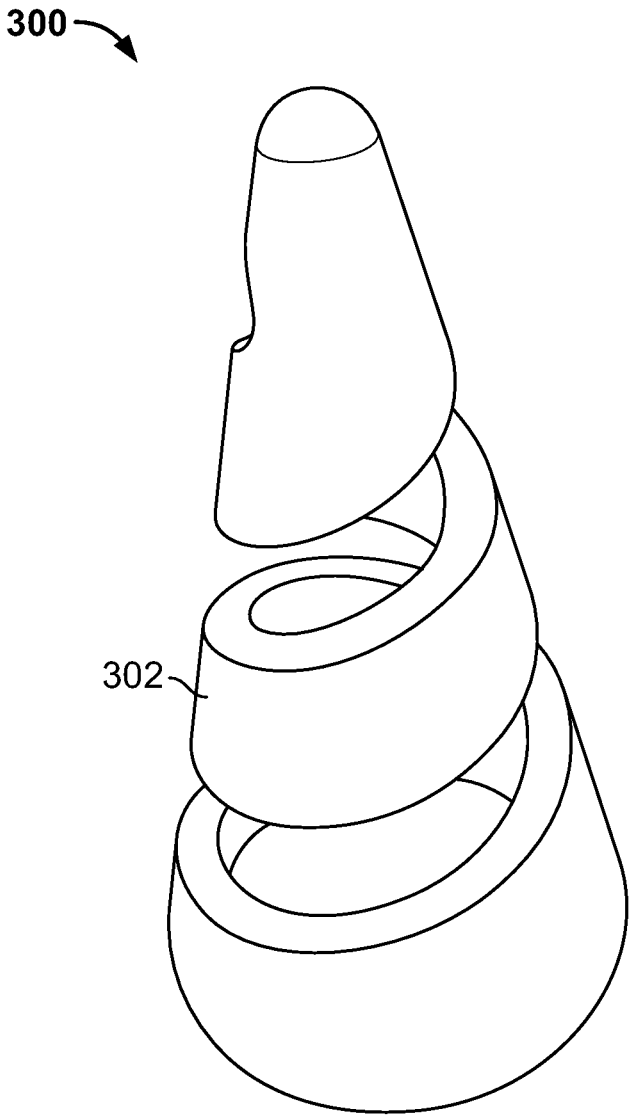
FIG. 3 is an illustration of a portion of an example mixing structure.

Referring to FIG. 3, an example of a mixing structure 300 is illustrated. The mixing structure 300 is configured to be received within the interior chamber 106 of the container 102 and mix the product. In an example, the mixing structure 300 is movable within the interior chamber 106 of the container 102 with respect to the wall 104. The mixing structure 300 can move freely within the interior chamber 106. As such, when the mixing assembly 100 is moved, shook, rotated, etc. by a user, the mixing structure 300 can cause a vortex flow of the product within the container 102, thus facilitating mixing of the product.

The mixing structure 300 can comprise a body portion 302. The body portion 302 has a substantially conical shape. While the body portion 302 may comprise any number of different materials, in an example, the body portion 302 may comprise a plastic material, a composite material, etc. The body portion 302 is substantially rigid so as to reduce the likelihood of deformation, bending, etc. when the body portion 302 is moved within the container 102 and makes contact with the wall 104 of the container 102.

Figure 4:
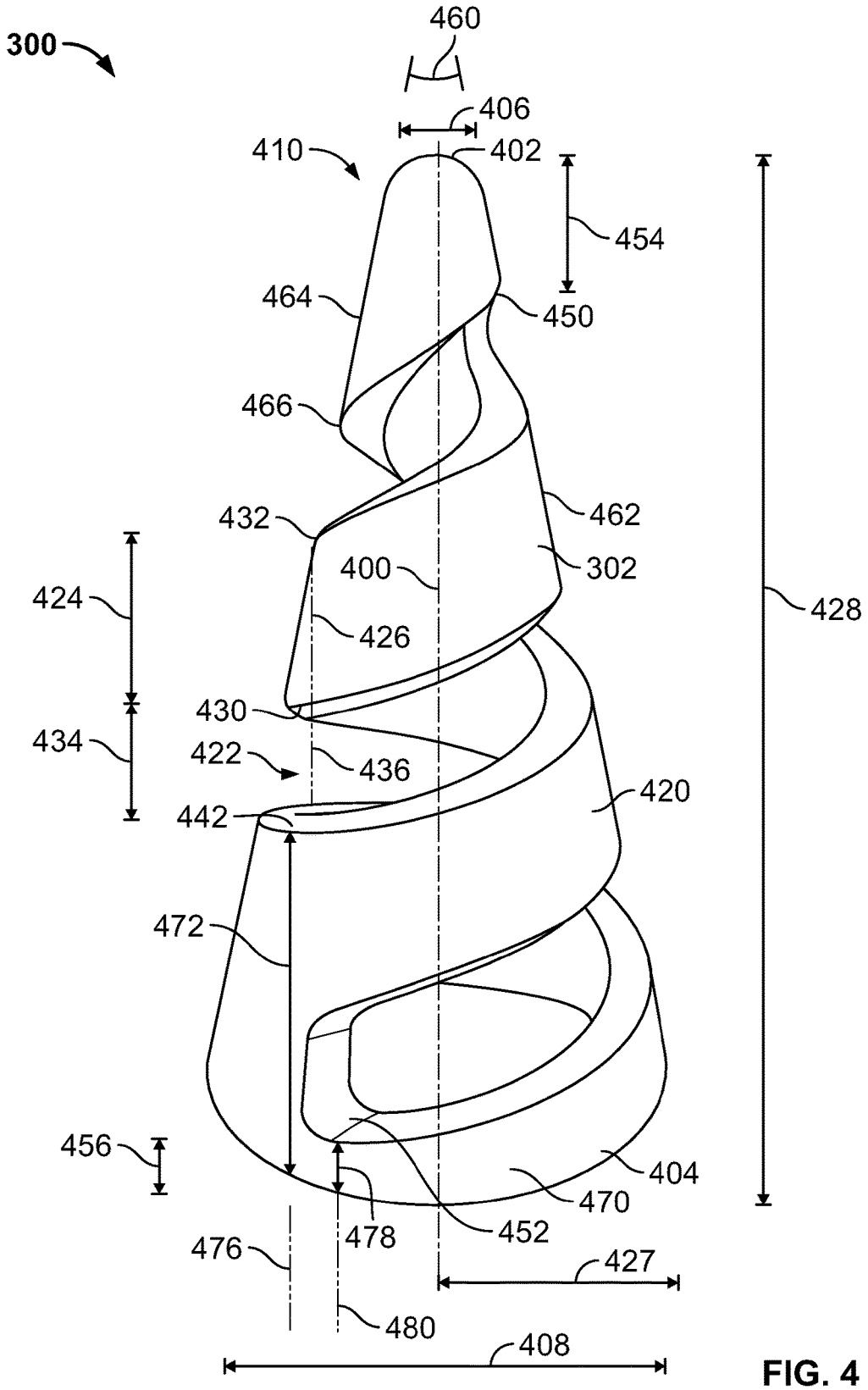
FIG. 4 is an illustration of a portion of an example mixing structure.
Figure 5:
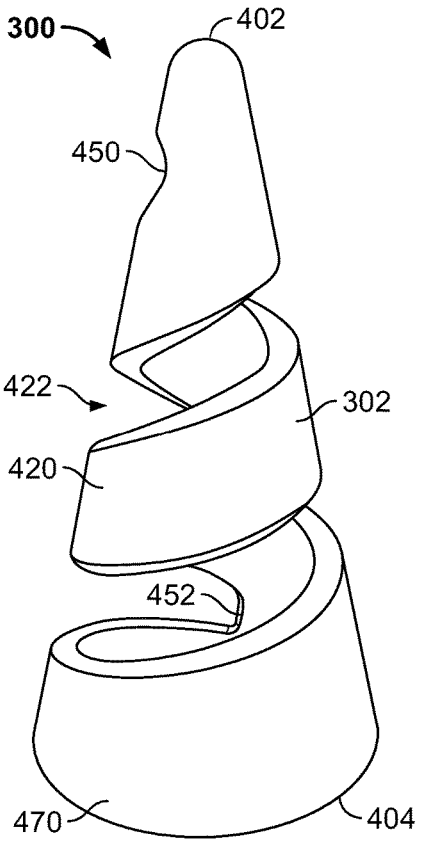
FIG. 5 is an illustration of a portion of an example mixing structure.

Referring to FIGS. 4 and 5, the mixing structure 300 is further illustrated. In this example, the body portion 302 can extend along a body axis 400 between a first end 402 of the body portion 302 and a second end 404 of the body portion 302. The body portion 302 extends concentrically about the body axis 400, such that the body axis 400 extends through a center of the body portion 302 between the first end 402 and the second end 404 of the body portion 302.

The mixing structure 300 can have a varying cross-sectional size along the body axis 400. For example, the first end 402 of the body portion 302 can have a first cross-sectional size 406. The second end 404 of the body portion 302 can have a second cross-sectional size 408. In an example, the second cross-sectional size 408 may be larger than the first cross-sectional size 406. That is, the body portion 302 can have a tapered shape along the body axis 400, such that the body portion 302 has an increasing cross-sectional size from the first end 402 to the second end 404.

The second cross-sectional size 408 may be less than a cross-sectional size of the container 102, such that the mixing structure 300 can be received within the interior chamber 106 of the container 102. In an example, a length of the mixing structure 300 (e.g., as measured between the first end 402 and the second end 404) can be greater than the cross-sectional size of the container 102. As such, when a user inserts the mixing structure 300 into the interior chamber 106, the mixing structure 300 is limited from being inverted. That is, the mixing structure 300 may be inserted such that the first end 402 of the mixing structure 300 faces a bottom of the container 102 while the second end 404 of the mixing structure 300 may face a top (e.g., an opening and the cover 110) of the container 102. In such an example, due to the dimensions of the mixing structure 300, the relative positions of the first end 402 and the second end 404 with respect to the container 102 may remain in place, despite the container 102 being moved, shaken, rotated, etc. Accordingly, in the previous example, when the container 102 is moved, shaken, rotated, etc., the first end 402 of the mixing structure 300 may remain facing the bottom of the container 102 while the second end 404 of the mixing structure 300 may remain facing the top of the container 102.

In the illustrated example, the first end 402 of the body portion 302 can define a substantially conically shaped tip 410. The tip 410 can be substantially solid and may be free of voids, openings, channels, etc. The tip 410 may have a rounded end, such that the tip 410 can access corners of the container 102. In this way, the tip 410 can function to remove non-liquid portions of the product from the corners of the container 102 and improve mixing of the product. The mixing structure 300 can be oriented such that the first end 402 of the body portion 302 faces a bottom of the container 102 (e.g., opposite the opening and the cover 110 at the top). Such an orientation allows for the tip 410 to engage and contact the lower corners of the container 102, such that the tip 410 can remove non-liquid portions of the product that adhere to, are stuck within, etc. the lower corners of the container 102.

The body portion 302 comprises a wall 420 that extends helically about the body axis 400 between the first end 402 and the second end 404. In this example, the wall 420 can define a channel 422 (e.g., an opening, a void, etc.) that extends helically about the body axis 400 between the first end 402 and the second end 404. By extending helically, the wall 420 and the channel 422 can have a first cross-sectional size at a first location (e.g., adjacent to the first end 402), and a second cross-sectional size at a second location (e.g., adjacent to the second end 404). The first cross-sectional size may be less than the second cross-sectional size. The wall 420 and the channel 422 can extend and/or wrap around the body axis 400 with a constantly increasing cross-sectional size from the first end 402 towards the second end 404.

The wall 420 can have a wall length 424, along a wall axis 426 that is substantially parallel to the body axis 400, between a first edge 430 of the wall 420 and a second edge 432 of the wall 420. In an example, the channel 422 can have a channel length 434, along a channel axis 436 that is substantially parallel to the body axis 400 and/or the wall axis 426, between the first edge 430 of the wall 420 and a third edge 442 of the wall 420. In an example, the first edge 430 and the second edge 432 define opposing edges of the wall at a location along the wall axis 426. The first edge 430 and the third edge 442 can define opposing edges of the channel 422 at a location along the channel axis 436. In this example, there may not be a portion of the wall located between the first edge 430 and the third edge 442, such that the first edge 430 and the third edge 442 are separated from each other by the channel 422.

In an example, the wall length 424 of the wall 420 may be larger than the channel length 434 of the channel 422. That is, as measured along the wall axis 426, the wall 420 can have a length (e.g., the wall length 424) that is larger than a length (e.g., the channel length 434) of the channel 422, as measured along the channel axis 436. In an example, the wall length 424 may be substantially constant between the first end 402 and the second end 404. Likewise, in an example, the channel length 434 may be substantially constant between the first end 402 and the second end 404. In other examples, the dimensions of the wall 420 and/or the channel 422 are not so limited. For example, the wall 420 can have a non-constant wall length 424 between the first end 402 and the second end 404, such that the wall 420 can have an increasing, a decreasing, etc. wall length 424. Likewise, in an example, the channel 422 can have a non-constant channel length 434 between the first end 402 and the second end 404, such that the channel 422 can have an increasing, a decreasing, etc. channel length 434.

In an example, the surface area of an exterior surface of the body portion 302 (e.g., of the solid portions) can comprise at least about 50% of a total possible surface area of the body portion 302 (e.g., the solid portions and the channels 422). The surface area may be represented as:

$$A=\pi r(r+\sqrt{(h^2+r^2)})$$

In the above equation, the surface area is defined by the variable A. The radius of the second end 404 of the body portion 302 is defined by r. The length (e.g., or height) of the body portion 302 between the first end 402 and the second end 404 is defined by h. In the illustrated example, the radius (r) is identified with reference number 427. The length of the body portion 302 (*h*) is defined with the reference number 428.

In an example, a surface area of the channel 422 as defined between the wall 420 may be less than about 50% of a total possible possible surface area of the body portion 302 (e.g., the solid portions and the channels 422). In such an example, the surface area of an exterior surface of the body portion 302 (e.g., of the solid portions) may be larger than the surface area of the channel 422 as defined between the wall 420. In another example, the surface area of an exterior surface of the body portion 302 (e.g., of the solid portions) can comprise at least about 60% of a total possible surface area of the body portion 302 (e.g., the solid portions and the channels 422).

In this way, the body portion 302 of the mixing structure 300 may be substantially solid but for the channel 422. As a result, mixing of the product is improved. For example, the product may contact the wall 420 and/or other solid portions of the body portion 302, with a reduced likelihood of the product passing through the channel 422 without contact the wall 420.

The channel 422 can extend between a first channel end 450 and a second channel end 452. In an example, the first channel end 450 of the channel 422 may be spaced a first channel distance 454 from the first end 402 of the body portion 302. The first channel distance 454 may be substantially equal to the channel length 434. In an example, the second channel end 452 of the channel 422 may be spaced a second channel distance 456 from the second end 404 of the body portion 302. The second channel distance 456 may be less than the channel length 434 of the channel 422.

In an example, the first channel end 450 of the channel 422 may be axially offset from the second channel end 452 of the channel 422. For example, as illustrated in FIG. 4, an axis may intersect the first channel end 450, with the axis extending substantially parallel to the body axis 400. In such an example, the axis may not intersect the second channel end 452. Rather, the second channel end 452 may be offset from the first channel end 450, such that the first channel end 450 and the second channel end 452 do not lie in an axis that is substantially parallel to the body axis 400. This offset of the first channel end 450 and the second channel end 452 can assist in mixing the product.

An angle 460 can be defined between a first side 462 of the body portion 302 and a second side 464 of the body portion 302 that is opposite the first side 462. In an example, the angle 460 may be between about 15 degrees to about 45 degrees. The angle 460 allows for the mixing structure 300 to access corners of the container 102, such that the tip 410 can function to remove the non-liquid portions of the product.

In an example, the body portion 302 can define a substantially planar outer surface 466 between the first end 402 and the second end 404. The outer surface 466 can comprise the first side 462, the second side 464, etc. By being substantially planar, the outer surface 466 can assist in mixing the product by contact and scraping an interior surface of the wall 104 of the container 102. As an example, the tip 410 of the body portion 302 can contact and/or scrape against a corner of the container 102. Concurrently, the outer surface 466 can contact the wall 104 of the container 102. The outer surface 466 may be substantially parallel to and in contact with the wall 104. As such, the mixing structure 300 can move in flush contact with the wall 104 as the container 102 is moved, shaken, rotated, etc. In such an example, the mixing structure 300 can function to remove non-liquid portions of the product (e.g., powder, etc.) from the wall 104, such as by scraping the wall 104.

The body portion 302 may comprise a second end base 470 located at the second end 404 of the body portion 302. The second end base 470 can define a solid area of the body portion 302 between the channel 422 and the second end 404. The second end base 470 can have a second base length 472 as measured from the second end 404. The second base length 472 can be measured along a second base axis 476 that extends between the first end 402 and the second end 404, with the second base axis 476 substantially parallel to the body axis 400. In this example, the second base length 472 may be larger than the wall length 424. Similarly, in this example, the second base length 472 may be larger than the channel length 434. In the illustrated example, the second base length 472 may be larger than a sum of the wall length 424 and the channel length 434.

At another circumferential location, the second end base 470 can have a third base length 478 as measured from the second end 404. The third base length 478 can be measured along a third base axis 480 that extends between the first end 402 and the second end 404, with the third base axis 480 substantially parallel to the body axis 400. In this example, the third base length 478 may be less than the wall length 424. In this example, the third base length 478 may be less than the channel length 434. In the illustrated example, the third base length 478 may be less than the second base length 472.

The second end base 470 can assist in mixing the product within the container 102. For example, the second end base 470 has the non-constant base length (e.g., the second base length 472, the third base length 478, etc.) at different circumferential locations about the second end 404 of the body portion 302. As the mixing structure 300 is rotated, product can contact the second end base 470 and pass through the channel 422 at the second channel end 452.

Figure 6:
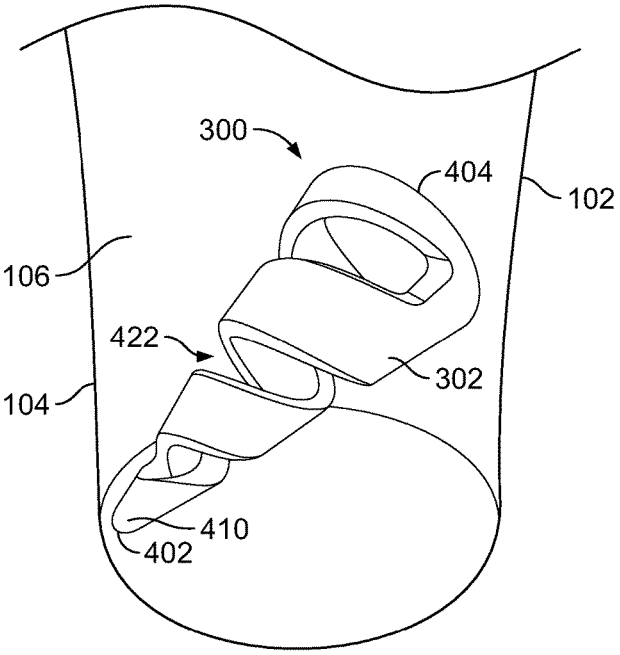
FIG. 6 is an illustration of an example mixing assembly.

Turning to FIG. 6, a bottom of the mixing assembly 100 is illustrated. In this example, the mixing structure 300 can be received within the interior chamber 106 of the container 102. The mixing structure 300 may be freely movable within the interior chamber 106. As such, a user can move the container 102, such as by rotating, shaking, etc. the container 102. As the user moves/rotates/shakes the container 102, the conically shaped tip 410 may engage corners of the container 102. This engagement can reduce the likelihood of product settling in the corners and not mixing. Instead, the conically shaped tip 410 can cause the product in the corners of the container 102 to be mixed/blended.

In addition, the outer surface 466 of the mixing structure 300 is substantially planar, such that the outer surface 466 can be substantially flush with and in contact with the wall 104 of the container 102. As the user moves/rotates/shakes the container 102, the outer surface 466 can contact/engage the wall 104 of the container. This engagement can reduce the likelihood of product adhering to the wall 104 and not mixing properly. Instead, the outer surface 466 can function to remove at least some of the product that adheres to the wall 104, thus facilitating mixing of the product.

The structure of the mixing structure 300 can allow for some of the product to flow through the channel 422. As the product flows through the channel 422, the product is mixed. In addition, the mixing structure 300 can rotate within the interior chamber 106 of the container 102. This rotation can cause a vortex, in which the product rotates about an axis. The formation of the vortex by the mixing structure 300 can further cause mixing of the product. As such, due to the mixing assembly 100 being moved/shaken/rotated, the mixing structure 300 can cause the product located within the interior chamber 106 to be mixed from a heterogeneous composition to a homogeneous composition.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Various operations of embodiments are provided herein. The order in which some or all of the operations described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first location and a second location correspond to location A and location B or two different or two identical locations or the same location.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are to be construed to mean "one or more" unless specified otherwise or clear from context to be directed to a singular form. Also, at least one of A and B or the like means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A mixing assembly comprising:

a container having a wall that defines an interior chamber within which a product to be mixed is received; and a mixing structure configured to be received within the interior chamber and mix the product, the mixing structure having:

a body portion that extends along a body axis between a first end of the body portion and a second end of the body portion, the first end of the body portion having a first cross-sectional size, the second end of the body having a second cross-sectional size that is larger than the first cross-sectional size, the body portion having:

a wall that extends helically about the body axis between the first end and the second end, the wall defining a channel that extends helically about the body axis between the first end and the second end, the wall having:

a first wall length, along a first wall axis that is substantially parallel to the body axis, between a first edge of the wall and a second edge of the wall; and a second wall length, along a second wall axis that is substantially parallel to the first wall axis, between a third edge of the wall and the second end, wherein the first wall length is different than the second wall length, wherein the mixing structure is unconstrained such that the mixing structure is freely rotatable within the interior chamber about the body axis and at least one additional axis that is non-colinear with the body axis, and wherein a cross-section of the mixing structure at a location along the body axis between the first end and a first channel end of the channel yields an ellipse.

2. The mixing assembly of claim 1, wherein the second cross-sectional size is less than a cross-sectional size of the container.

3. The mixing assembly of claim 1, wherein the first end of the body portion defines a substantially conical shape.

4. The mixing assembly of claim 1, wherein a first channel end of the channel is spaced a first channel distance from the first end of the body portion and the first channel distance is substantially equal to a channel length of the channel.

5. The mixing assembly of claim 1, wherein the ellipse is a circle.

6. The mixing assembly of claim 1, wherein a second channel end of the channel is spaced a second channel distance from the second end of the body portion and the second channel distance is less than a channel length of the channel.

7. The mixing assembly of claim 1, wherein an angle defined between a first side of the body portion and a second side of the body portion that is opposite the first side is between about 15 degrees to about 45 degrees.

8. The mixing assembly of claim 1, wherein the first channel end of the channel is axially offset from a second channel end of the channel.

9. The mixing assembly of claim 1, wherein an outer surface of the body portion extends substantially linearly between the first end and the second end.

10. A mixing assembly comprising:

a container having a wall that defines an interior chamber within which a product to be mixed is received; and a mixing structure configured to be received within the interior chamber and mix the product, the mixing structure movable within the container with respect to the wall, the mixing structure having:

a body portion that extends along a body axis between a first end of the body portion and a second end of the body portion, the first end of the body portion having a first cross-sectional size, the second end of the body having a second cross-sectional size that is larger than the first cross-sectional size, the body portion having:

a wall that extends helically about the body axis between the first end and the second end, the wall defining a channel that extends helically about the body axis between the first end and the second end, the product flowing through the channel to mix the product as the mixing structure moves within the container, a first channel end of the channel spaced a first channel distance from the first end of the body portion, a cross-section of the mixing structure at a location along the body axis between the first end and the first channel end yields an ellipse.

11. The mixing assembly of claim 10, wherein the ellipse is a circle.

12. The mixing assembly of claim 1, wherein the channel has a channel length, along a channel axis that is substantially parallel to the body axis, between the first edge of the wall and the third edge of the wall, the first wall length larger than the channel length.

13. The mixing assembly of claim 12, wherein a first channel end of the channel is spaced a first channel distance from the first end of the body portion and the first channel distance is substantially equal to the channel length.

14. The mixing assembly of claim 10, wherein a second channel end of the channel is spaced a second channel distance from the second end of the body portion.

15. The mixing assembly of claim 14, wherein the second channel distance is less than a channel length of the channel.

16. A mixing assembly comprising:

a container having a wall that defines an interior chamber within which a product to be mixed is received; and a mixing structure configured to be received within the interior chamber and mix the product, the mixing structure having:

a body portion that extends along a body axis between a first end of the body portion and a second end of the body portion, the first end of the body portion having a first cross-sectional size, the second end of the body having a second cross-sectional size that is larger than the first cross-sectional size, the body portion having:

a wall that extends helically about the body axis between the first end and the second end, the wall defining a channel that extends helically about the body axis between the first end and the second end, a first channel end of the channel spaced a first channel distance from the first end of the body portion, a cross-section of the mixing structure at a location along the body axis between the first end and the first channel end yields an ellipse.

17. The mixing assembly of claim 16, wherein the ellipse is a circle.

18. The mixing assembly of claim 16, wherein a length of the mixing structure between the first end and the second end is less than a width of the container.

19. The mixing assembly of claim 16, wherein an angle defined between a first side of the body portion and a second side of the body portion that is opposite the first side is between about 15 degrees to about 45 degrees.

20. The mixing assembly of claim 16, wherein the body portion has a substantially conically-shaped tip.

* * * * *